US007175059B2

(12) United States Patent
Copich

(10) Patent No.: US 7,175,059 B2
(45) Date of Patent: Feb. 13, 2007

(54) HYDRATION DEVICE/GOLF BAG CARRYING HARNESS COMBINATION

(76) Inventor: Michael Copich, 1003 Offutt Blvd., Bellevue, NE (US) 68005

( * ) Notice: Subject to any disclaimer, the term of this patent is extended or adjusted under 35 U.S.C. 154(b) by 415 days.

(21) Appl. No.: 10/866,411

(22) Filed: Jun. 12, 2004

(65) Prior Publication Data

US 2005/0184112 A1 Aug. 25, 2005

Related U.S. Application Data

(60) Provisional application No. 60/547,698, filed on Feb. 25, 2004.

(51) Int. Cl.
*A45F 5/00* (2006.01)

(52) U.S. Cl. ..... 224/148.2; 224/148.5; 224/148.6; 224/605; 224/627; 224/583

(58) Field of Classification Search .. 224/148.1–148.7, 224/583, 627, 603–605, 153
See application file for complete search history.

(56) References Cited

U.S. PATENT DOCUMENTS 5,263,618 A * 11/1993 Talavera ..... 224/148.5
5,400,934 A * 3/1995 Ducros ..... 224/148.2
5,601,207 A * 2/1997 Paczonay ..... 220/703
5,816,460 A * 10/1998 Cook ..... 224/260
6,152,343 A * 11/2000 Shin ..... 224/645
6,216,926 B1 * 4/2001 Pratt ..... 224/153
6,216,932 B1 * 4/2001 Wu ..... 224/583
6,382,489 B2 * 5/2002 Chuang ..... 224/637

* cited by examiner

*Primary Examiner*—Gregory Vidovich
(74) *Attorney, Agent, or Firm*—Adam H. Jacobs

(57) ABSTRACT

A hydration device/golf bag carrying harness combination including a golf bag carrying harness including a pair of shoulder-engaging loop straps and a rear connection section from which the pair of shoulder-engaging loop straps extend in a general V-shape from the upper portion of the rear connection section. A hydration device includes a liquid container, a liquid delivery tube and at least two mounting straps extending from and connected to the hydration device. At least two strap engagement clips are mounted on the rear connection section of the golf bag carrying harness generally adjacent the upper portion of the rear connection section to each releasably engage one of the mounting straps. Finally, the liquid delivery tube extends forwards of the golf bag carrying harness such that a wearer of the hydration device may access liquids stored in the liquid container without having to disconnect the container from the harness.

9 Claims, 5 Drawing Sheets

HYDRATION DEVICE/GOLF BAG CARRYING HARNESS COMBINATION

CROSS-REFERENCE TO RELATED PROVISIONAL PATENT

This application claims priority based on a provisional patent, specifically on the Provisional Patent Application Ser. No. 60/547,698 filed Feb. 25, 2004.

BACKGROUND OF THE INVENTION

1. Technical Field

The present invention relates to water-carrying devices and, more particularly, to a hands-free hydration device mounted on a golf bag carrying harness which is supported on the harness wearer's back and is easily accessible via a drinking tube or the like to obtain hydrating fluids therefrom.

2. Description of the Prior Art

Golf is one of the fastest growing sports in the country and is being taken up by an ever-increasing number of participants of all ages and abilities. One unfortunate result of the increased number of golfers, however, is that the golf courses themselves are under ever-greater stress and various ways are constantly being contemplated to reduce the golf course stress levels. One method which has been successful is to eliminate the use of golf carts on the golf course which often cause damage to the fairways and areas surrounding the greens on the course due to the tires of the golf cart. This problem is particularly prevalent in golfing situations where the course has been rain-soaked or in golf courses built on sandy surfaces, where the turf is easily torn up by the use of golf carts. By eliminating the use of golf carts, this problem is removed. However, the disadvantage to removing golf carts from the golf course is that the golfers must then carry their clubs with them and thus they are generally limited in the amount of liquids that they can carry with them for hydration purposes. Although this problem is somewhat alleviated by the presence of water coolers on the golf course, contamination of the water coolers is a constant problem and therefore there is a need for an easily portable liquid source which can be carried by the golfer in an easy and efficient manner, yet will not interfere with his or her enjoyment of the golfing experience.

Many different types of portable liquid sources are found on the market, including such devices as the "Camelback" and other such backpack-oriented water supply devices. While these could be used by the golfer for hydration purposes, the golfer will eventually feel like a pack mule as he or she carries the golf bag, the portable water supply, and any other golfing accessories he or she needs to play the round. Furthermore, each time the golfer needs to hit a shot, he or she would have to remove the golf bag and then remove the backpack-oriented water supply device, hit the shot, and then put the backpack-oriented water supply device and golf bag back on his or her person. While this does not seem a particularly arduous task, when multiplied by the average eighty or ninety times which the process would be repeated during the round of golf, it is seen that the use of such a backpack-oriented water supply device in combination with the golf bag and any other golf accessories will severely detract from the enjoyment of the round of golf. There is therefore a need for a water supply device which is usable in conjunction with the carrying of a golf bag, yet will not require the user to undertake additional steps for removal and replacement of the device on his or her person.

Therefore, an object of the present invention is to provide a hydration device/golf bag carrying harness combination.

Another object of the present invention is to provide a hydration device/golf bag carrying harness combination which includes a pair of shoulder-engaging straps which loop around the front of the wearer's body, the straps connected to the rear thereof to the golf bag with a generally V-shaped section formed at the point where the shoulder straps meet on the wearer's back above the golf bag mount.

Another object of the present invention is to provide a hydration device/golf bag carrying harness combination which includes a liquid container section having a plurality of mounting straps mounted thereon for connecting the liquid container section to the golf bag carrying harness section adjacent the V-shaped section directly above the fastening point for the golf bag.

Another object of the present invention is to provide a hydration device/golf bag carrying harness combination in which the liquid container section is removably mounted on the golf bag carrying harness section by a plurality of mounting clips which are releasable to permit quick and easy refilling of the liquid container.

Another object of the present invention is to provide a hydration device/golf bag carrying harness combination which is easy to use for golfers of all abilities and sizes and which will generally not detract from the enjoyment of playing golf.

Finally, an object of the present invention is to provide a hydration device/golf bag carrying harness combination which is relatively simple in design and construction and is safe and efficient in use.

SUMMARY OF THE INVENTION

The present invention provides a hydration device/golf bag carrying harness combination including a golf bag carrying harness including a pair of shoulder-engaging loop straps and a rear connection section from which the pair of shoulder-engaging loop straps extend in a general V-shape from the upper portion of the rear connection section. The rear connection section of the golf bag carrying harness is adapted for releasable connection to a golf bag such that the golf bag carrying harness is usable for carrying of a golf bag and a hydration device includes a liquid container, an outflow tube and at least two mounting straps extending from and connected to the hydration device. At least two strap engagement clips are mounted on the rear connection section of the golf bag carrying harness generally adjacent the general V-shape of the upper portion of the rear connection section with the two strap engagement clips each operative to releasably engage one of the mounting straps to removably mount the hydration device on the rear connection section of the golf bag carrying harness. Finally, the outflow tube extends from the liquid container forwards of the golf bag carrying harness such that a wearer of the hydration device may access liquids stored in the liquid container free of releasing the hydration device from the golf bag carrying harness.

The present invention provides a substantial improvement over those hydration devices found in the prior art. For example, because the hydration device and golf bag carrying harness are integrally connected, removal of the golf bag carrying harness also results in removal of the hydration device from the wearer of the harness, thus permitting the user to perform only a single removal and replacement process to hit a golf shot, thus saving time and effort. Furthermore, because the hydration device may be used in a "hands-free" mode, with the user merely accessing the bite valve to obtain water, the hydration device may be used at any time during the round, even if the wearer is occupied with other tasks. Finally, because the hydration device may be quickly and easily removed from and replaced on the golf bag carrying harness, refilling of the liquid container from any appropriate water or hydrating fluid source may be quickly and easily done. It is thus clear that the present invention provides a substantial improvement over those devices found in the prior art.

DESCRIPTION OF THE PREFERRED EMBODIMENT

Figure 1:
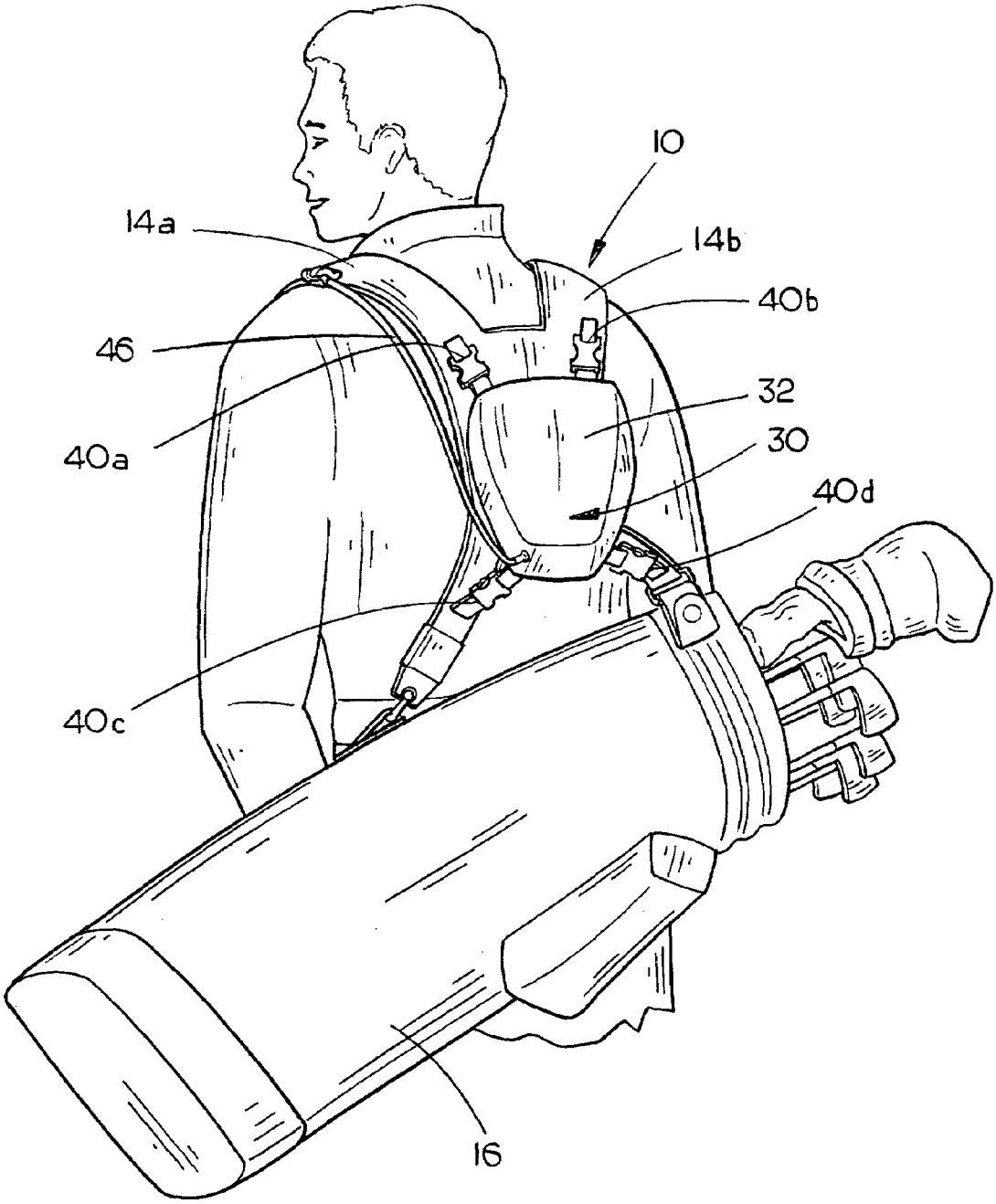
FIG. 1 is a perspective view of the hydration device/golf bag carrying harness combination of the present invention being worn by a user.
Figure 2:
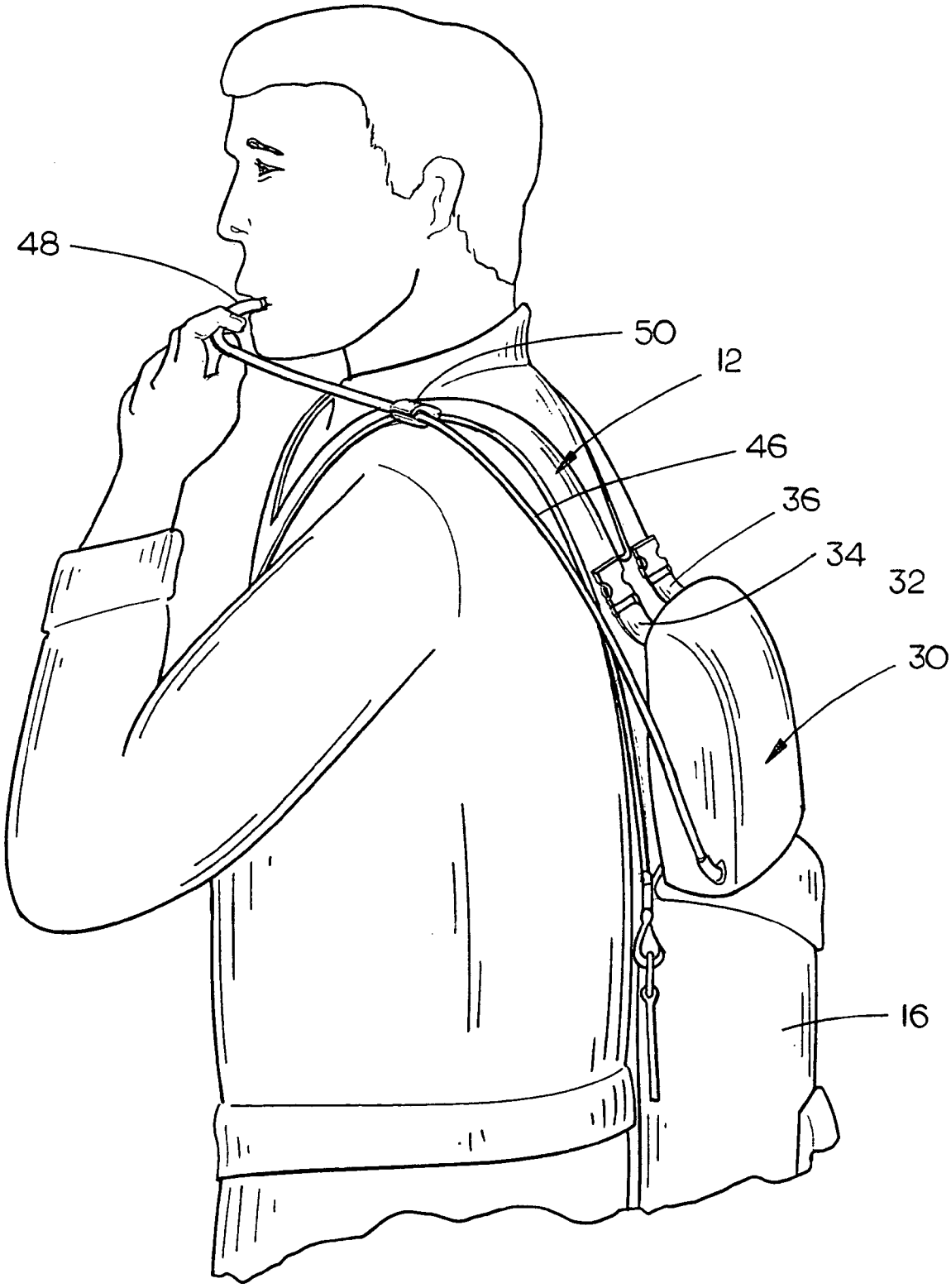
FIG. 2 is a side elevational view of the hydration device/golf bag carrying harness combination of the present invention dispensing hydrating fluids.
Figure 3A:
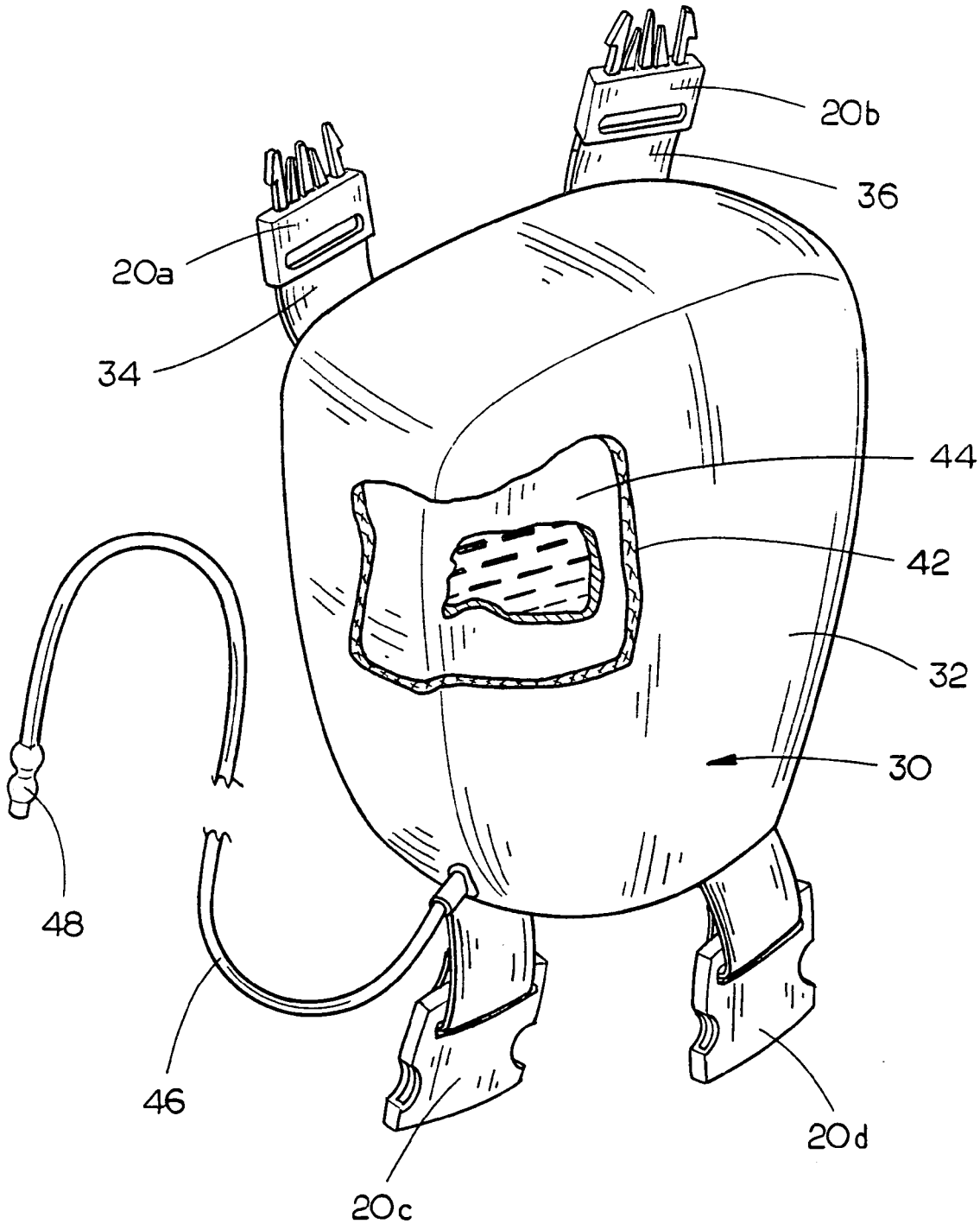
FIGS. 3*a* and 3*b* are detail perspective views of various strap combinations used for mounting the hydration device on the golf bag carrying harness.
Figure 3B:
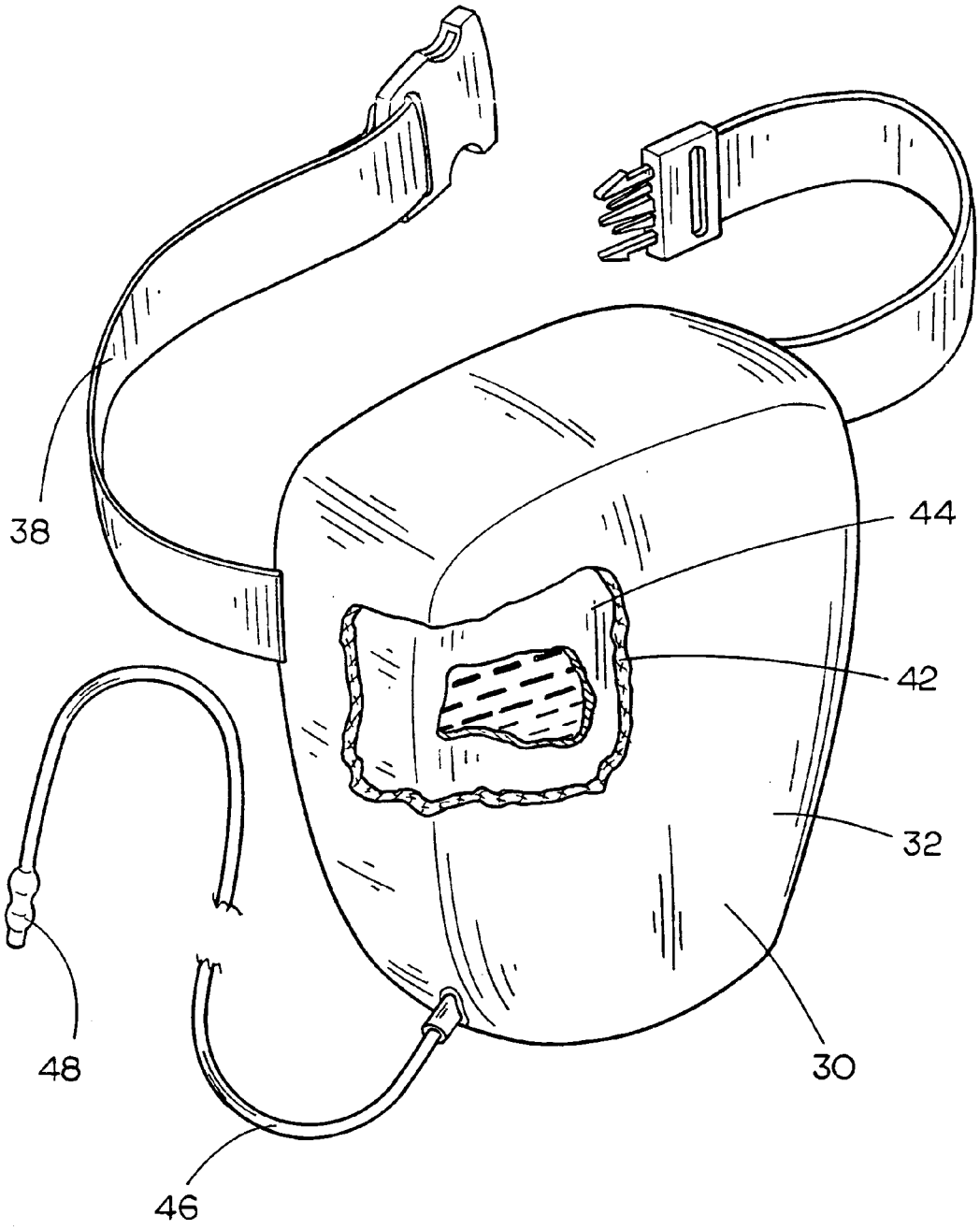

The hydration device/golf bag carrying harness 10 of the present invention is shown best in FIGS. 1–3*b* as including a golf bag carrying harness section 12 and a liquid container section 30 which is preferably removably mounted on the golf bag carrying harness section 12. In the preferred embodiment, the golf bag carrying harness section 12 would include a pair of shoulder-engaging straps 14*a* and 14*b* which loop around the front of the wearer's body and are connected at the rear of the golf bag carrying harness section 12 to the golf bag 16 itself such that the weight of the golf bag 16 and golf clubs carried therein is distributed substantially evenly on the shoulder-engaging straps 14*a* and 14*b* to facilitate the support and carrying of the golf bag 16. Above the point of connection to the golf bag 16, the shoulder-engaging straps 14*a* and 14*b* form a V-shape which points upward to the neck of the wearer of the golf bag carrying harness section 12. Mounted adjacent this V-shaped section 18 is liquid container section 30 which includes the liquid container 32 itself and a plurality of mounting straps 34 and 36 which secure the liquid container 32 to the shoulder-engaging straps 14*a* and 14*b* adjacent V-shaped section 18, as shown best in FIGS. 1 and 2. In the preferred embodiment, a plurality of mounting clips 20*a*, 20*b*, 20*c* and 20*d* would be mounted on the shoulder-engaging straps 14*a* and 14*b*, as shown in FIG. 1. These mounting clips 20*a*–*d* would preferably be constructed of a semi-flexible plastic material and would be operated in a manner generally associated with fastening clips, which would be understood by one skilled in the art. Mounted on the ends of straps 34 and 36 are a plurality of fastening clip engagement devices 40*a*, 40*b*, 40*c* and 40*d* which are designed to engage the fastening clips 20*a*–*d*, as shown best in FIG. 1 and releasably secure the liquid container 32 on the shoulder-engaging straps 14*a* and 14*b*. Of course, the precise arrangement of straps 34 and 36, fastening clips 20*a*–*d* and fastening clip engagement devices 40*a*, 40*b*, 40*c* and 40*d* may be modified or changed, depending on the golf bag carrying harness 12 which is being used with the present invention. For example, the liquid container 32 may be mounted on the golf bag carrying harness 12 via only a single strap 38 which would wrap around the golf bag carrying harness 12, as shown in FIG. 3*b*, and such modifications and changes would be understood by one skilled in the art of clip devices.

In the preferred embodiment, liquid container 32 would preferably be a plastic container holding approximately one-half to one gallon of water or other such hydrating liquid and would be contained within a fabric outer cover 42 which provides both protection for the inner water bladder 44 and improves the aesthetic appearance of the liquid container 32 itself.

Extending outwards from the inner water bladder 44 through outer cover 42 is a liquid delivery tube 46 which ends in a "bite" valve 48 for delivery of liquid to the individual wearing the hydration device/golf bag carrying harness 10 of the present invention. In the preferred embodiment, the liquid delivery tube 46 would extend either over the shoulder of the individual wearing the present invention or under the arm of the individual and the bite valve 48 could be secured on the forward portion of the shoulder-engaging strap 14*a* and 14*b* via any appropriate strap or securement device, depending on the aesthetic appearance and performance characteristics desired by the user of the present invention. For example, a simple plastic clip 50 could be mounted on the front of one of the shoulder-engaging straps 14*a* and 14*b* into which the bite valve 48 or liquid delivery tube 46 would be fastened when not in use. To use the bite valve 48, the wearer of the hydration device/golf bag carrying harness 10 of the present invention would merely take the bite valve 48 from the clip 50, insert the bite valve 48 into his or her mouth and bite down on the bite valve 48. By exerting a moderate degree of suction, liquid would be drawn from the inner water bladder 44 of liquid container 32 through liquid delivery tube 46 into bite valve 48 and there into the wearer's mouth for hydrating purposes. The present invention thus provides an easy-to-use means of hydrating oneself while generally not interfering with the golfing experience.

It should also be noted that as golf is often played in hot weather, not only should the inner water bladder 44 of the liquid container 32 be insulated to keep the liquid as cool as possible, it also may be important to insulate the liquid delivery tube 46 and the bite valve 48 in order to keep liquid held within the tube and valve as cool as possible. In the preferred embodiment, this insulation would be accomplished by a variety of methods and devices, with the most likely being to provide an insulated flap (not shown) adjacent to plastic clip 50 to cover the bite valve 48 when it is not in use and further to wrap the liquid delivery tube 46 in an insulating material such as foam rubber or the like, or to add a reflective material to the outer surface of the liquid delivery tube 46 to deflect the sun's rays away therefrom. It is believed that the insulation of the liquid delivery tube 46 and the bite valve 48 in order to keep liquid held within the tube and valve as cool as possible, in addition to the insulation for the inner water bladder 44 of the liquid container 32, will be an important and desirable feature of the present invention.

The substantial advantages provided by the present invention include that the weight of the hydrating liquid, such as water, is centrally located on the person's back wearing the invention, thus allowing them to carry more water with them and substantially eliminating the risk of injury due to unbalanced loads. Furthermore, the wearer/user of the present invention will be able to keep the hydrating liquid cooler for a longer period of time due to the inner water bladder 44 being insulated by the outer cover 42 and the user will not have to worry about finding uncontaminated water in the water coolers which are distributed throughout the golf course. Finally, because the liquid container section 30 may be quickly and easily removed from the golf bag carrying harness section 12 via fastening clips 20*a–d* and fastening clip engagement devices 40*a–d*, the liquid container 32 may be quickly and easily refilled, as might need to be done between nines on the golf course. The present invention thus provides a substantial improvement over those devices found in the prior art.

Figure 5:
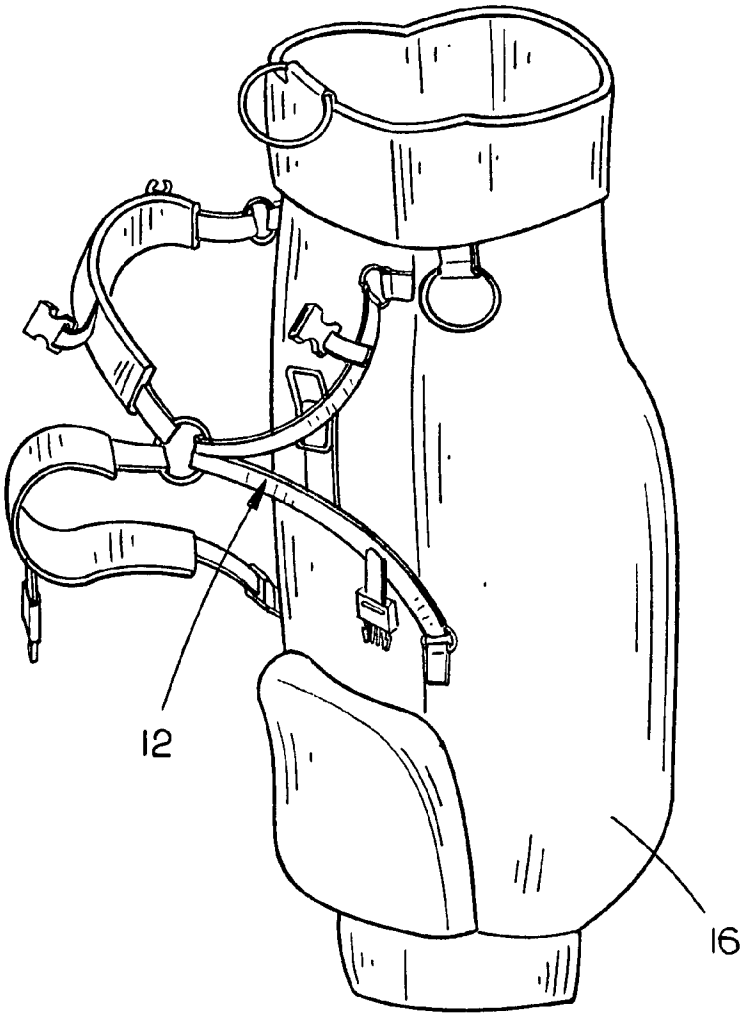
FIGS. 4 and 5 are perspective views of alternative types of golf bag carrying harnesses which are usable with the present invention.
Figure 4:
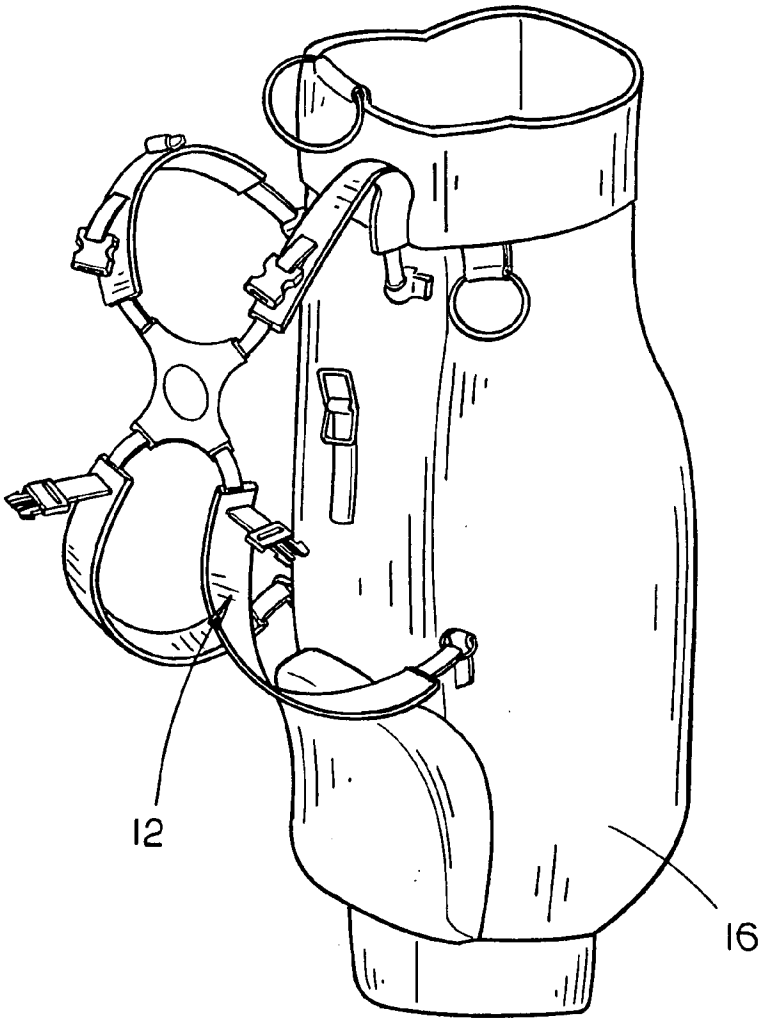

It is to be further understood that numerous additions, modifications, and substitutions may be made to the hydration device/golf bag carrying harness 10 of the present invention which fall within the intended broad scope of the above description. For example, the exact nature of the golf bag carrying harness section 12 may be modified or changed, as various manufacturers produce different types of golf bag harnesses, such as the examples shown in FIGS. 4 and 5, any of which are quickly and easily modified for use with the present invention. Furthermore, the size, shape, and number of liquid contained 32 and straps 34 and 36 are not critical to the present invention so long as the liquid container 32 is safely and easily mounted on the golf bag carrying harness section 12 via the fastening clips 20*a–d* and fastening clip engagement devices 40*a–d*. Finally, although the present invention has been described as including a liquid delivery tube 46 and bite valve 48, other types of liquid delivery devices may be used with the present invention so long as the intended function of transferring liquid from the liquid container 32 to the individual wearing the present invention is maintained.

There has therefore been shown and described a hydration device/golf bag carrying harness 10 which accomplishes at least all of its intended purposes.

I claim:

1. A hydration device/golf bag carrying harness combination comprising:

a golf bag carrying harness including a pair of shoulder-engaging loop straps, a rear connection section from which said pair of shoulder-engaging loop straps extend in a general V-shape from the upper portion of said rear connection section, and a pair of connection straps extending from the bottom portion of said rear connection section;

ends of said shoulder-engaging loop straps and said connection straps adapted for releasable connection to a golf bag such that said golf bag carrying harness is usable for carrying of a golf bag;

a hydration device including a liquid container, a liquid delivery tube connected in liquid transmission connection to said liquid container at one end thereof and at least two mounting straps extending from and connected to said hydration device;

at least two strap engagement clip means mounted on said shoulder engaging loop straps generally adjacent said rear connection section;

said at least two strap engagement clip means each operative to respectively releasable engage one of said at least two mounting straps to removably mount said hydration device on said rear connection section of said golf bag carrying harness; and said liquid delivery tube extending from said liquid container forwards of said golf bag carrying harness such that a wearer of said hydration device may access liquids stored in said liquid container free of releasing said hydration device from said golf bag carrying harness.

2. The hydration device/golf bag carrying harness combination of claim 1 wherein said at least two mounting straps extending from and connected to said hydration device each further include one section of a mounting clip each mounted on said at least two mounting straps generally adjacent the free end of said at least two mounting straps.

3. The hydration device/golf bag carrying harness combination of claim 2 wherein said at least two strap engagement clip means each comprise one section of a mounting clip adapted to releasably engage a respective one section of said mounting clip on said at least two mounting straps extending from and connected to said hydration device to securely and releasably connect said hydration device to said golf bag carrying harness.

4. The hydration device/golf bag carrying harness combination of claim 1 wherein said liquid delivery tube further comprises a valve means mounted on the outer end of said liquid delivery tube operative to control liquid flow therethrough.

5. The hydration device/golf bag carrying harness combination of claim 4 wherein said valve means is a bite valve having valve opening means adapted to be operated by a user's mouth to draw liquid through said liquid delivery tube.

6. The hydration device/golf bag carrying harness combination of claim 4 further comprising an insulation material mounted on and generally surrounding said liquid container.

7. A hydration device/golf bag carrying harness combination comprising:

a golf bag carrying harness including a pair of shoulder-engaging loop straps, a rear connection section from which said pair of shoulder-engaging loop straps extend in a general V-shape from the upper portion of said rear connection section, and a pair of connection straps extending from the bottom portion of said rear connection section;

ends of said shoulder-engaging loop straps and said connection straps adapted for releasable connection to a golf bag such that said golf bag carrying harness is usable for carrying of a golf bag;

a hydration device including a liquid container, a liquid delivery tube connected in liquid transmission connection to said liquid container at one end thereof, a valve means mounted on said liquid delivery tube for controlling liquid flow therethrough and at least two mounting straps extending from and connected to said hydration device;

shoulder-engaging loop straps and said connection straps generally adjacent said rear connection section with at least one of said at least two strap engagement clips mounted above another of said at least one of said at least two strap engagement clips, said at least two strap engagement clips being mounted in vertical spaced relation;

said at least two strap engagement clips each operative to respectively releasably engage one of said at least two mounting straps to removably mount said hydration device on said golf bag carrying harness with at least one of said mounting straps extending to said at least one of said at least two strap engagement clips mounted above said rear connection section and at least one of said mounting straps extending to said at least one of said at least two strap engagement clips mounted below said rear connection section such that said hydration device is releasably secured to said golf bag carrying harness both above and below said hydration device; and said liquid delivery tube extending from said liquid container forwards of said golf bag carrying harness such that a wearer of said hydration device may engage said valve means and thereby access liquids stored in said liquid container free of releasing said hydration device from said golf bag carrying harness.

8. The hydration device/golf bag carrying harness combination of claim 7 wherein said valve means is a bite valve having valve opening means adapted to be operated by a user's mouth to draw liquid through said liquid delivery tube.

9. The hydration device/golf bag carrying harness combination of claim 7 further comprising an insulation material mounted on and generally surrounding said liquid container.

* * * * *